US011408225B1

(12) United States Patent
Godfrey

(10) Patent No.: US 11,408,225 B1
(45) Date of Patent: Aug. 9, 2022

(54) STEP STOOL

(71) Applicant: Preston Godfrey, Westfield, MA (US)

(72) Inventor: Preston Godfrey, Westfield, MA (US)

( * ) Notice: Subject to any disclaimer, the term of this patent is extended or adjusted under 35 U.S.C. 154(b) by 0 days.

(21) Appl. No.: 17/682,287

(22) Filed: Feb. 28, 2022

(51) Int. Cl.
*A47C 12/00* (2006.01)
*E06C 1/00* (2006.01)

(52) U.S. Cl.
CPC ..... *E06C 1/005* (2013.01); *A47C 12/00* (2013.01); *A47B 2220/05* (2013.01)

(58) Field of Classification Search
CPC ..... B60R 3/02; E06C 1/005; A47B 2220/05; A47B 77/10; A47B 46/00; A47B 46/005; A47C 12/00
See application file for complete search history.

(56) References Cited

U.S. PATENT DOCUMENTS 2,555,149 A 4/1948 Mushta
2,567,630 A * 9/1951 Whittier ..... A47C 17/86 312/301
2,801,894 A 6/1956 MacInnes
2,971,600 A 2/1959 Schultz
2,881,040 A 4/1959 Hartridge
3,030,166 A 7/1959 Richards et al.
3,008,533 A * 11/1961 Haberle ..... B60R 3/02 182/88
3,136,386 A 6/1964 Horvath et al.
3,291,255 A * 12/1966 Glatfelter ..... B60R 3/02 182/88
3,311,190 A 3/1967 Naumann
3,481,429 A * 12/1969 Gaede ..... E06C 1/005 182/88
3,645,557 A * 2/1972 Aldropp ..... B60R 3/02 280/166
3,743,320 A 7/1973 Clark
3,756,678 A 9/1973 Kloppenstein
3,796,456 A * 3/1974 Bergeson ..... B60R 3/02 296/156
2,956,638 A 8/1974 Bustin
4,135,604 A 1/1979 Ryan
4,846,304 A 7/1989 Rasmussen
4,924,970 A * 5/1990 Seals ..... E06C 1/005 182/195
5,005,667 A 4/1991 Anderson
5,094,515 A 3/1992 Low
5,341,897 A 8/1994 Gross
(Continued)

*Primary Examiner* — Colleen M Chavchavadze
(74) *Attorney, Agent, or Firm* — Richard Kosakowski

(57) ABSTRACT

A cabinet mounted step stool can be collapsed to a narrow horizontal profile for storage without compromising usefulness of the cabinet. The step stool is supported on support channels fastened to two side walls of the cabinet. A pair of fixed track channels are supported on the support channels with the fixed track channel openings facing each other, within which two sliding track channels slide with one on the left and the other on the right. Four step support assemblies, each of which comprises a step support with one end pivotally attached to a roller and the other end pivotally attached to a foot. Two rollers slide within the left and other two rollers slide within the right sliding track channel. Two steps are supported on four corners by the four step support assemblies. When extended, the step stool provides two steps with approximately 13½" rise in height.

17 Claims, 12 Drawing Sheets

(56) References Cited

U.S. PATENT DOCUMENTS

| | | | | |
|---|---|---|---|---|
| 5,366,052 | A * | 11/1994 | Keh-Lin | E06C 5/02 182/127 |
| 5,697,470 | A | 12/1997 | Carle | |
| 7,516,997 | B2 * | 4/2009 | Kuznarik | B62D 33/0273 182/127 |
| 7,815,266 | B2 * | 10/2010 | Sun | H05K 7/1488 312/223.1 |
| 8,678,411 | B2 * | 3/2014 | Kibler | B60R 3/02 182/127 |
| 8,689,939 | B2 * | 4/2014 | Kim | E06C 5/08 182/127 |
| 9,290,991 | B1 * | 3/2016 | McDill | E06C 1/005 |
| 9,994,141 | B1 * | 6/2018 | Hanser | B60P 3/36 |
| 10,316,584 | B1 * | 6/2019 | Cooper | A47B 88/413 |
| 10,518,708 | B1 * | 12/2019 | Honer | B60R 3/02 |
| 10,538,205 | B2 * | 1/2020 | Iotti | E06C 5/04 |
| 10,717,456 | B2 * | 7/2020 | Shrago | A47C 12/00 |
| 2004/0251080 | A1 * | 12/2004 | Kalos | E06C 1/387 182/35 |
| 2007/0240936 | A1 * | 10/2007 | Brookshire | E06C 7/081 182/127 |
| 2019/0037799 | A1 * | 2/2019 | Murray | A01K 1/0272 |
| 2019/0351832 | A1 * | 11/2019 | Fuller | E06C 5/36 |
| 2020/0102788 | A1 * | 4/2020 | Byers | E06C 7/505 |

* cited by examiner

STEP STOOL

FIELD OF THE INVENTION

The subject matter disclosed herein relates in general to step stools, and more specifically to a retractable step stool mounted to a cabinet, a bathroom vanity, a kitchen appliance, or the like.

BACKGROUND OF THE INVENTION

In common households, kitchens or bathrooms often have both upper and lower cabinets. The lower cabinets typically rest on the floor of the room and are attached to the wall while the upper cabinets are located a distance above the lower cabinets. Many modern kitchens even have storage shelves located above the upper cabinets, which are usually out of reach from the floor for an average person. Similarly, bathroom vanity cabinets are designed for older children and adults to use and small children may have difficulty reaching the sink without utilizing a stool or ladder. Commodity stools or ladders are difficult to keep inside a room when not in use because they create clutter or obstacles within the room.

Known, prior art mounted step stools are commonly mounted in the lower cabinets for assisting people to access objects stored in the upper cabinets, shelves, storage places, or a functional facility such as a sink, which could not be reasonably and safely reached from the floor. The stool or ladder installed within a cabinet intends to be retrieved when in use and conveniently to be stored away when not in use.

Modern cabinetry is often constructed using inexpensive materials such as particle boards for interior shelves of a cabinet. The particle board has lesser mechanical strength and load bearing capacity in comparison with solid wood or plywood. Some prior art discloses step stools mounted to cabinet shelves, which may not be safe for shelves made of particle board.

In some prior art, mounted step stools have only a single step, which limits the height gain. For reaching cabinets or shelves at a sufficiently high location, the single-step stools may not be suitable for small children or relatively short adults to use.

Some prior art discloses step stools stored in the base toe kick of a lower cabinet. The toe kick must move as it has to open up for taking the step stool out when in use. Therefore, the toe kick is typically not sealed tightly to the floor, thereby allowing dirt and vermin to penetrate under the cabinet. Additionally, the depth of the steps of the stool is limited by the height of the base toe kick.

Therefore, what is needed is a step stool that allows sufficient height gain without sacrificing stability and safety, for example, having two steps, is retractable into a narrow horizontal profile to be easily stored within a cabinet without compromising the useful storage space of the cabinet, provides ease of cleaning without interrupting the cabinet base material, and provides simplicity of operation.

BRIEF SUMMARY OF THE INVENTION

An object of embodiments of the present invention is to provide a step stool that may be retracted into a closed configuration to be mounted within the interior of a support structure, such as a cabinet, when not in use.

Another object of embodiments of the present invention is to provide a step stool that may be extended into an extended configuration for use as a step stool to help people access an object that is difficult to reach from the floor.

Yet another object of embodiments of the present invention is to provide a step stool that is supported by side walls of the support structure instead of an interior shelf, thereby avoiding any deflection of the shelf and eliminating the need for shelf reinforcement. In addition, the shelf may be of standard shelf material, be positioned at a desired height, and pull out from the cabinet if desired.

Furthermore, an object of embodiments of the present invention is to provide a step stool with two steps with an exemplary rise and reach of approximately 13½" in height.

Another object of embodiment of the present invention is to provide a two-step stool that is stabilized by transferring load on the step stool to the floor, to the sides of the cabinet, and to the feet on the front and back step supports.

Yet another object of embodiments of the present invention is to provide a step stool that can be installed in a variety of widths to fit in various size cabinets.

Still another object of embodiments of the present invention is to provide a step stool whose horizontal dimension of the support channels is adjustable for matching the distance between the two side walls of the support structure.

Furthermore, another object of embodiments of the present invention is to provide a step stool that can be installed in new or existing cabinets with or without a cabinet face frame, or in cabinets with an inset or overlay doors, and requiring no modifications to the cabinet, face frame, or doors.

According to an embodiment of the present invention, a step stool comprises support channels oriented in parallel with each other in a horizontal plane. Each of the support channels is attached to side walls of a support structure, such as a cabinet. A left fixed track channel and a right fixed track channel are supported on the support channels, which are oriented transversely to the fixed track channels. The fixed track channels are so positioned that the openings of the two fixed track channels face each other and are separated by a distance to provide space for mounting steps.

The step stool further comprises a left sliding track channel and a right sliding track channel, each of which slides within one of the fixed track channels with the left sliding track channel sliding within the left fixed track channel and the right sliding track channel sliding within the right fixed track channel. The openings of the two sliding track channels face each other.

A plurality of steps is supported by four step support assemblies which are located besides the steps, where each of the step support assemblies is located in a corresponding side of the steps.

Each of the step support assemblies comprises a step support. One end of the step support is pivotally attached to a roller and the other end is pivotally attached to a foot assembly. The left rollers roll freely within the left sliding track channel and the right rollers roll freely within the right sliding track channel.

Each of the steps has a first surface for ascending and standing on the step stool and a second surface bound by a front rod and a back rod, which are aligned lengthwise along the step. The front and back rods are located at the front and back edges of the step, respectively.

Each end of the front rod is pivotally fastened to one of the front step support assemblies located in the corresponding side at one height. Each end of the back rod is pivotally fastened to one of the back step support assemblies located in the corresponding side at the same height.

BRIEF DESCRIPTION OF THE DRAWINGS

The subject matter, which is regarded as the disclosure herein of exemplary embodiments of the present invention, is particularly pointed out and distinctly claimed in the claims at the conclusion of this specification. The forgoing and other features and advantages of the present invention will become more apparent from the following detailed description taken in conjunction with the accompanying drawings in which:

DETAILED DESCRIPTION OF THE INVENTION

Figure 1A:
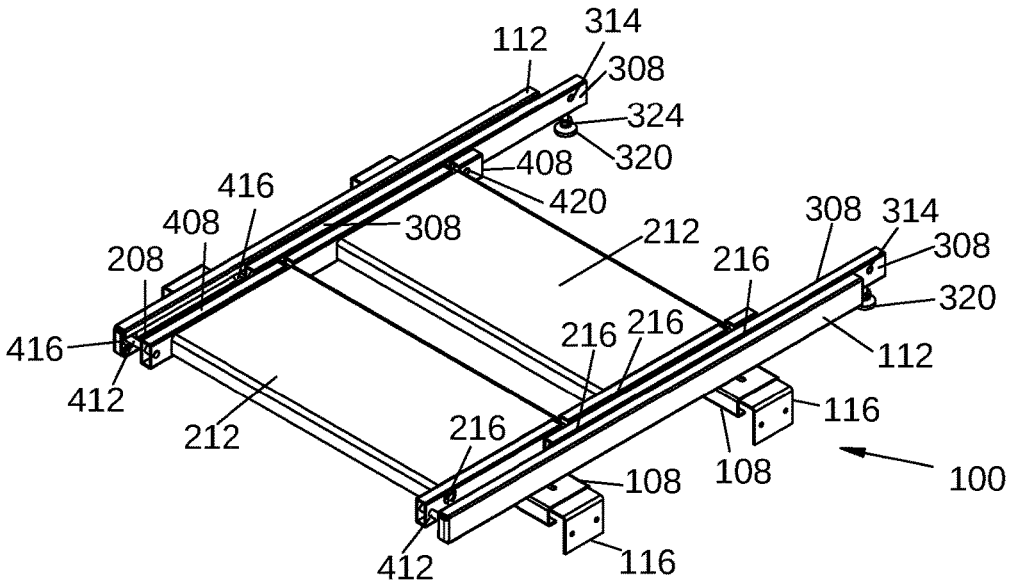
FIGS. 1*a* and 1*b* are isometric views of a step stool in a closed and an extended configuration, respectively, according to an embodiment of the present invention.

It should be understood that, throughout this patent application and specifically in the written description that follows and in the accompanying drawing figures, various directional terms such as horizontal, vertical, up, down, upwardly, downwardly, front, back, top, bottom, upper, lower, left, right, and other similar terms as they are used herein refer to the step stool 100 (see FIGS. 1*a* and 1*b*) of the various exemplary embodiments of the present invention as that step stool 100 is typically oriented when attached to a support structure 500 (see FIGS. 19*a* and 19*b*) such as a cabinet. All of these terms are used in this written description and in the drawings for convenience only and as an aid to better understanding the exemplary embodiments of the present invention. These terms are not intended to be limiting within the claims or to imply that the step stool 100 must be used or positioned in any particular orientation.

Figure 1B:
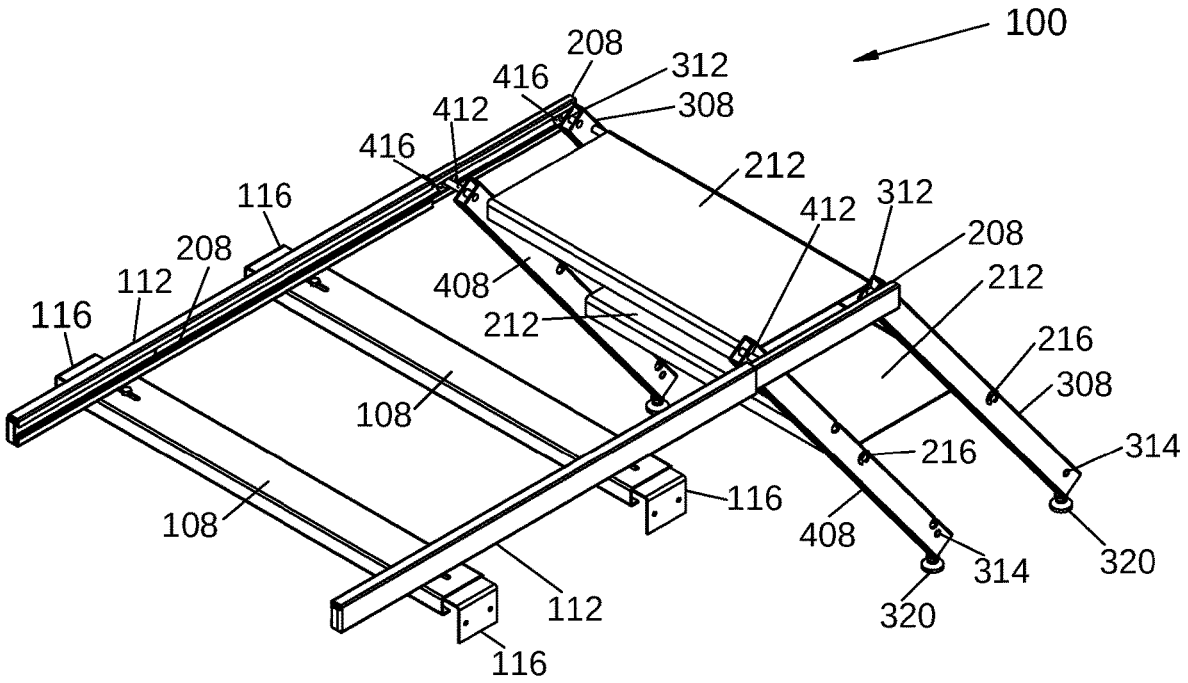

Referring to FIGS. 1*a* and 1*b*, there illustrated are isometric views of a step stool 100 according to an embodiment of the present invention. The step stool 100 is a useful tool in a common household for helping people to access objects stored at a height difficult to reach from the floor 600. When in storage, the step stool 100 can be collapsed to a narrow horizontal profile within a support structure, as such a cabinet 500 (see FIGS. 19*a* and 19*b*) without compromising the usefulness of the cabinet 500. When extended, the step stool 100 with two steps 212 may provide an exemplary rise in height of approximately 13½". The load on the extended step stool 100 is transferred to the floor 600 and to the side walls 504 of the cabinet 500. The step stool 100 is simple to operate which includes pulling out and dropping down when in use, and pulling up and pushing in when for storage. The step stool 100 may be installed within a narrow range of heights which allows a plurality of feet 320 to be placed in proper relation to the floor 600.

In the embodiment shown in FIG. 1*a*, the step stool 100 in the closed configuration is in a flat configuration of retraction, where the operable parts of the step stool 100 are collapsed into a horizontal planar orientation. The two sliding track channels 208 are fully nested within the fixed track channels 112 and all of the other parts of the step assembly 204 (see FIG. 8) are located between the two fixed track channels 112 in a horizontal planar orientation when not in use. The front step support assembly 304 and the back step support assembly 404 are supported in the horizontal position by resting on the support channels 108.

In the embodiment shown in FIG. 1*b*, the step stool 100 in the extended configuration has a two-step stool extended out with the feet 320 placed on the floor 600 in the vertical position for use. The two sliding track channels 208 are partially pulled out of the fixed track channels 112, and the front step support assemblies 304 and the back step support assemblies 404 are dropped down to have the feet 320 placed vertically on the floor 600 when in use. The step stool 100 includes a support channel assembly 104 (see FIGS. 2 and 3) and a step assembly 204 (see FIG. 8).

Figure 2:
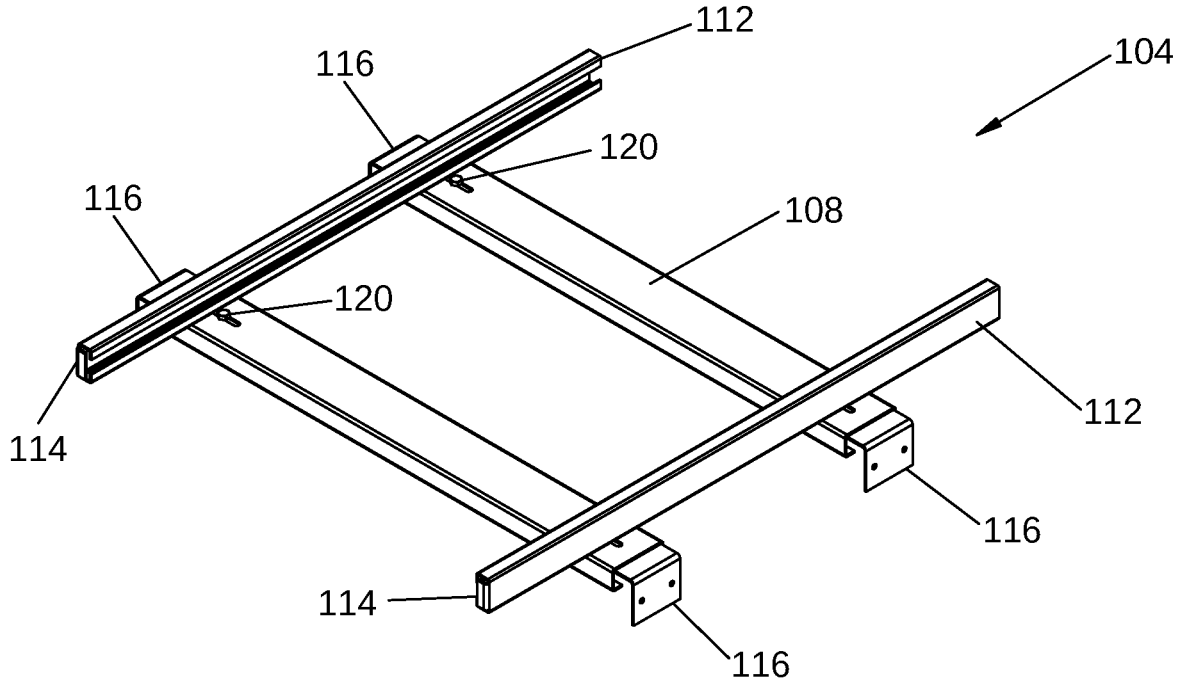
FIG. 2 is an isometric view of a support channel assembly according to the embodiment of the present invention of FIG. 1.
Figure 3:
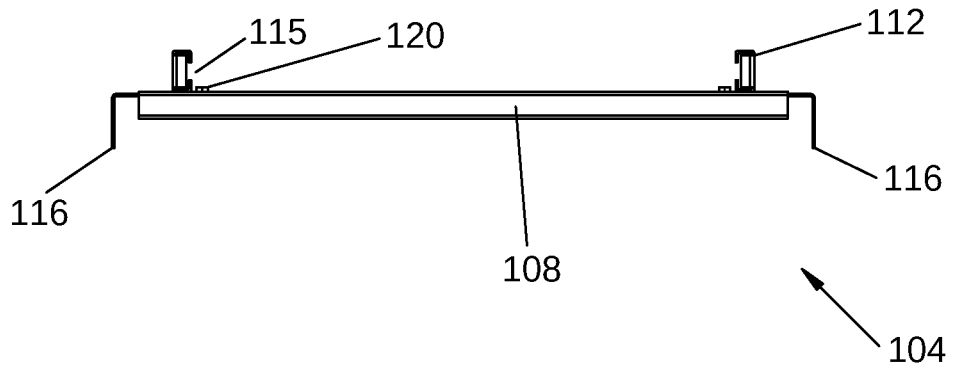
FIG. 3 is a front side view of the support channel assembly according to the embodiment of the present invention of FIG. 2.
Figure 6:
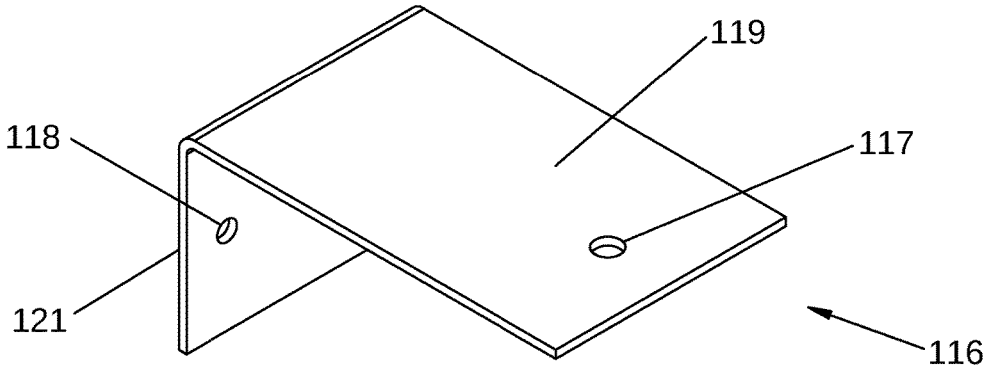
FIG. 6 is an isometric view of a mounting clip according to the embodiment of the present invention of FIG. 1.

Referring to FIGS. 2 and 3, according to an embodiment of the present invention, the support channel assembly 104 includes a plurality of support channels 108 and a pair of fixed track channels 112 supported by and permanently fastened to the support channels 108. In the embodiment shown in FIG.2, two support channels 108 are illustrated, however, any number of the support channels 108 may be utilized as necessary. The support channels 108 are typically installed to be parallel with each other when the step stool 100 is oriented in a horizontal plane. Each support channel 108 has one end fastened to one side wall 504 and the other end fastened to the opposite side wall 504 of a support structure 500 (see FIGS. 19*a* and 19*b*), using a set of mounting clips 116 (see FIG. 6). As such, the support channels 108 form a load bearing structure.

Figure 7A:
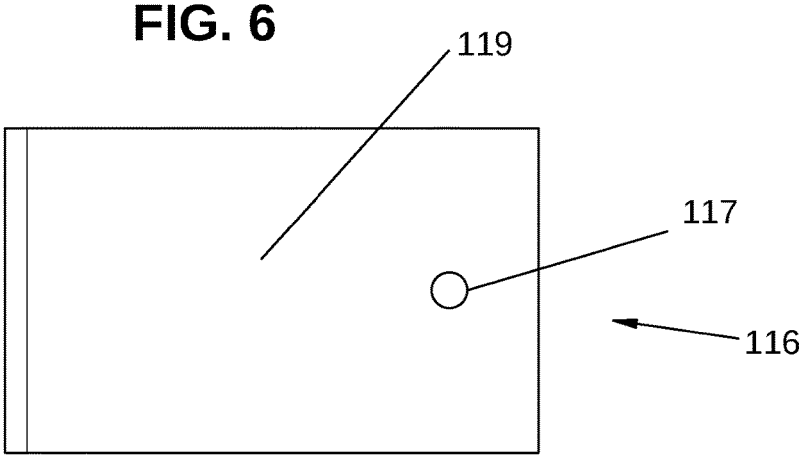
FIGS. 7*a*, 7*b*, and 7*c* are top, front, and left side views of the mounting clip, respectively, according to the embodiment of the present invention of FIG. 6.
Figure 7B:
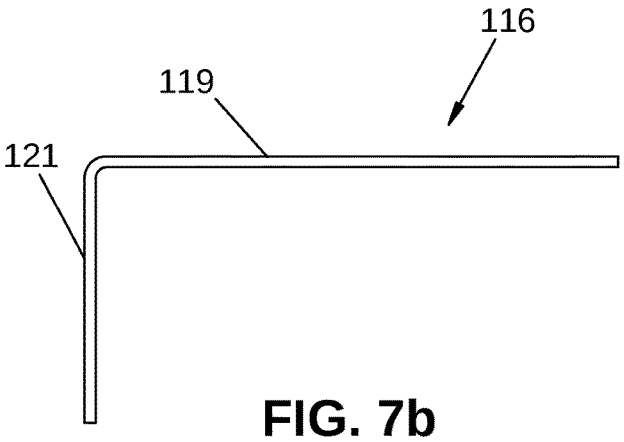
Figure 7C:
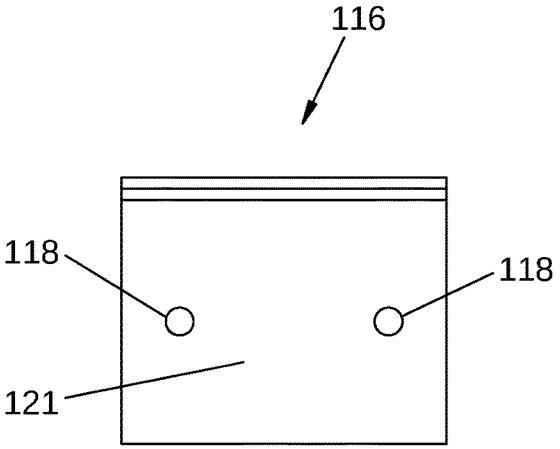

As shown in FIGS. 2 and 3, a plurality of the support channels 108 is disposed horizontally in parallel with each other with channel openings facing downward when mounted in a cabinet 500. Each support channel 108 is attached to two mounting clips 116 with one clip 116 on one end and the other clip 116 on the other end of the channel 108. As best seen in FIGS. 7*a*-7*c*, the mounting clip 116 is made of a plate bent to an approximately 90-degree angle to form a horizontal plate 119 and a vertical plate 121. The horizontal plate 119 is bolted to the support channel 108 by a bolt 120 and a corresponding lockout nut. The vertical plate 121 is fastened to a side wall 504 of the support structure 500 (FIG. 19).

As seen in FIG. 2, a pair of the fixed track channels 112 are supported on the support channels 108, each of which has a lengthwise opening 115. The fixed track channels 112 are positioned with a lengthwise edge plane in contact with the support channels 108 such that the openings 115 of the two fixed track channels 112 face each other. The support channels 108 establish a parallel spacing between the two fixed track channels 112 for mounting the step assembly 204 (see FIG. 8). The fixed track channel 112 located in the left configuration is a left fixed track channel 112 while the fixed track channel located in the right configuration is a right fixed track channel 112.

As seen in FIG. 3, one fixed track channel 112 is positioned near one end of the support channel 108 and the other fixed track channel 112 is near the other end of the support channel 108, both fixed track channels 112 being positioned above the mounting clips 116. Each of the fixed track channels 112 hosts one sliding track channel 208 (see FIG. 8) to slide and nest therein. The two fixed track channels 112 are separated by a distance determined by the dimensions of the step assembly 204 (see FIG. 8). The back end of each fixed track channel 112 is blocked by a back end plate 114 to prevent the sliding track channel 208 from extending out of the back of the fixed track channel 112. The front end of the fixed track channel 112 is left open.

Figure 4:
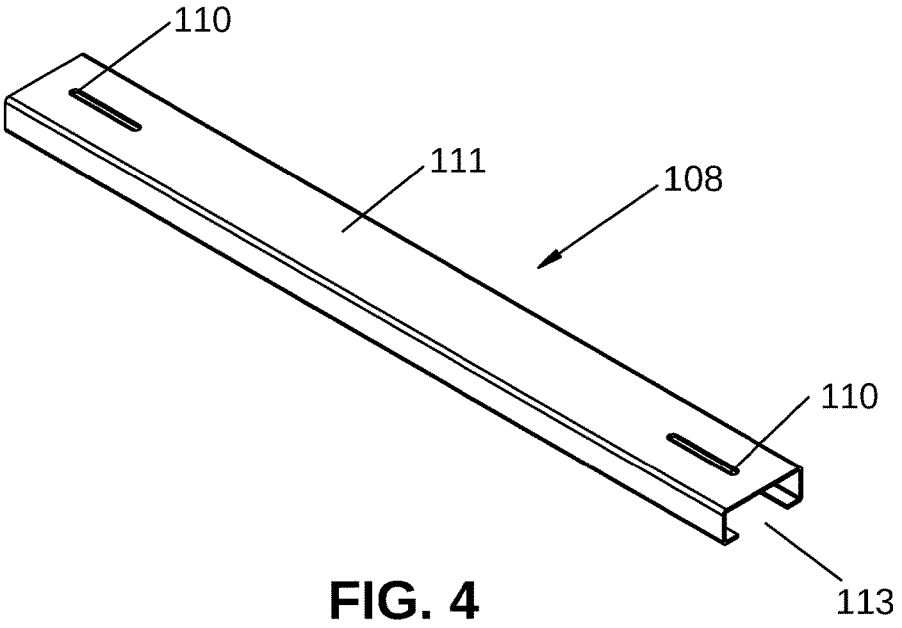
FIG. 4 is an isometric view of a support channel according to the embodiment of the present invention of FIG. 2.

Referring to FIG. 4, there illustrated is an exemplary embodiment of a support channel 108. The support channel 108 is constructed of a strip of sheet material shaped into a channel. The support channel 108 comprises an upper plate 111 including an upward facing surface and a downward facing surface, two slots 110 located in the upper plate, and a bottom opening 113. One slot 110 is located near one end of the support channel 108 and the other slot 110 is located near the other end of the support channel 108. The mounting clip 116 is attached to the downward facing surface of the support channel 108 by bolting through a hole 117 on the mounting clip 116 and the slot 110 in the upper plate of the support channel 108 (see FIGS. 2 and 3). The long dimension of the slot 110 offers flexibility for adjusting locations of the mounting clips 116 for extending to the two side walls 504 located on each side of the support structure 500 (see FIG. 2).

Figure 5:
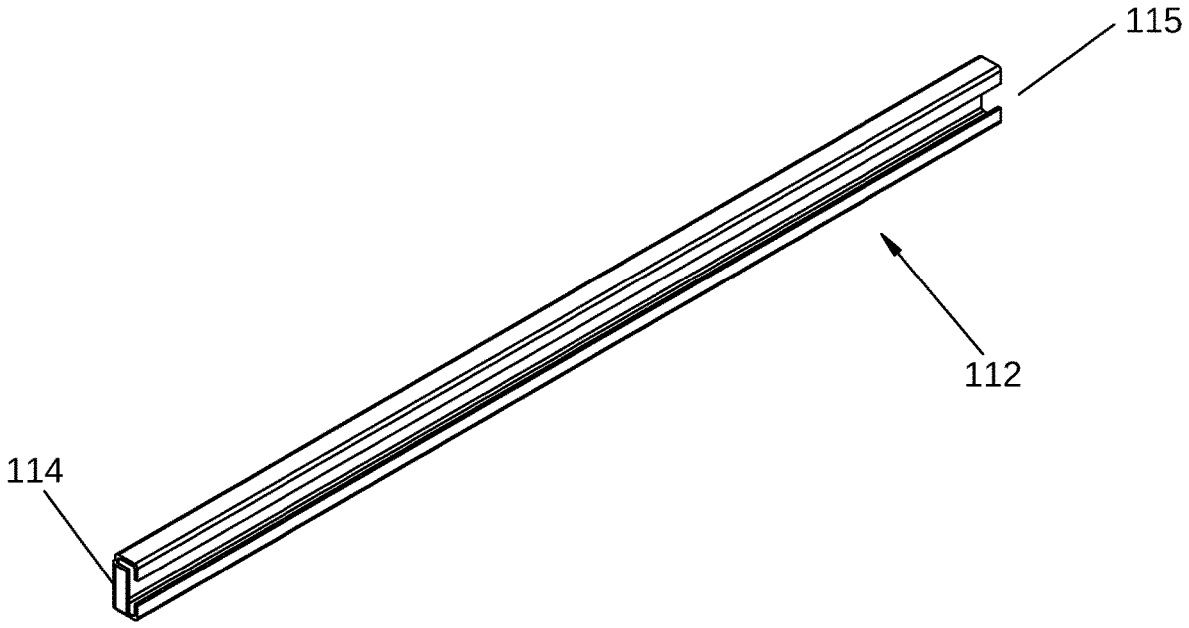
FIG. 5 is an isometric view of a fixed track channel according to the embodiment of the present invention of FIG. 2.

Referring to FIG. 5, there illustrated is an exemplary embodiment of a fixed track channel 112. Similar to the support channel 108, the fixed track channel 112 is constructed of a strip of sheet material shaped into a channel with a small back end plate 114 and a lengthwise opening 115. The fixed track channel 112 is so positioned that the channel opening 115 faces sideway to have the fixed track channel 112 provide a track for the sliding track channel 208 (see FIGS. 1*a* and 1*b*).

Referring to FIGS. 6 and 7*a*, 7*b*, and 7*c*, there illustrated is an exemplary embodiment of a mounting clip 116. The mounting clips 116 are attached to the support channel 108 by bolted joints and are extended to meet the side walls 504 of the support structure 500. The load on each one of the steps 212, for example from someone standing on the steps, is partially transferred through the fixed track channels 112 and the mounting clips 116 to the side walls 504 of the support structure 500 (see FIGS. 19*a* and 19*b*). The mounting clip 116 is constructed of a plate folded into two plates 119 and 121 which are perpendicular to each other. The horizontal plate 119 includes one hole 117 pinned to the support channel 108 and the vertical plate 121 includes two or more holes 118 fastened to a side wall 504 of the support structure 500 (see FIGS. 19*a* and 19*b*).

Figure 8:
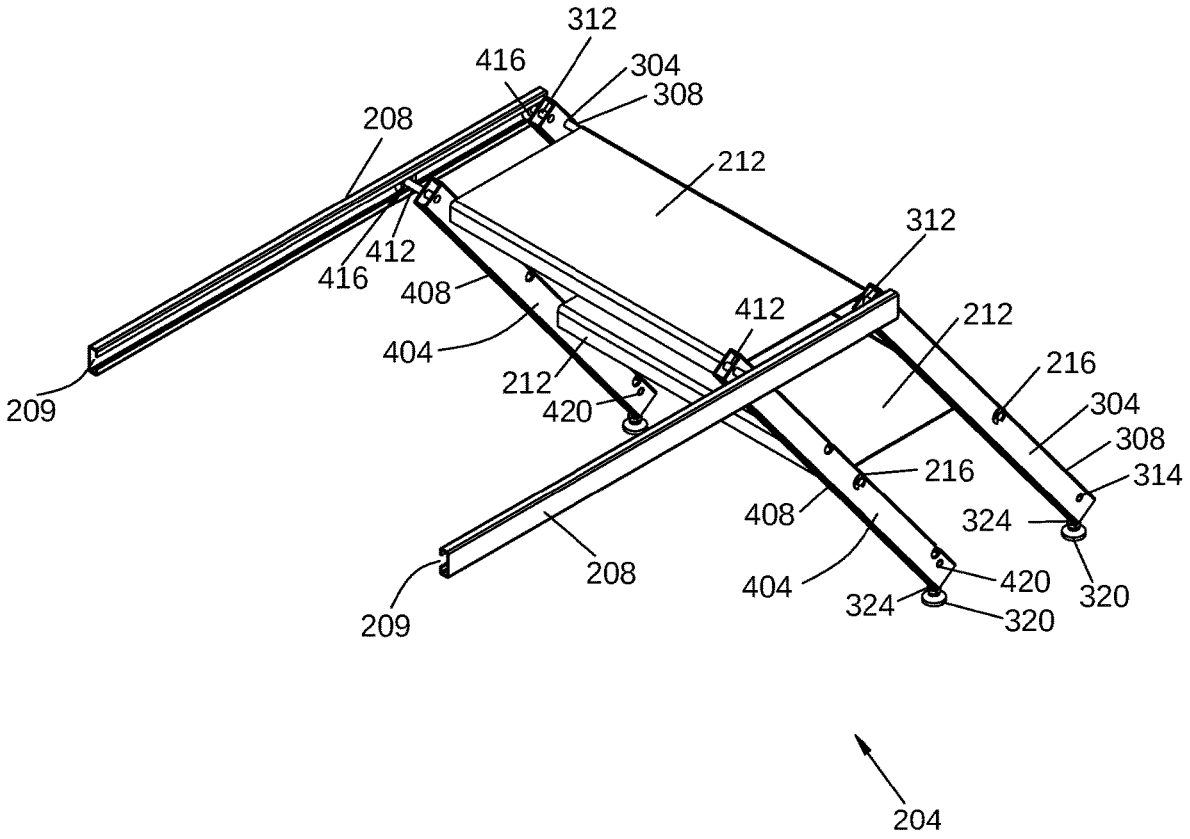
FIG. 8 is an isometric view of a step assembly in the extended configuration according to the embodiment of the present invention of FIG. 1.

Referring to FIG. 8, there illustrated is an isometric view of a step assembly 204 in the extended configuration. The step assembly 204 includes the operable parts of the step stool 100. The step assembly 204 includes a pair of sliding track channels 208, one of which is a left sliding track channel 208 in the left configuration and the other one is a right sliding track channel 208 in the right configuration, a pair of steps 212, two front step support assemblies 304, and two back step support assemblies 404.

Each of the sliding track channels 208 has a lengthwise opening 209 to provide a rolling track for rollers 416. The openings 209 of the two sliding track channels 208 face each other. Each one of the two front step support assemblies 304 and two back step support assemblies 404 includes a step support 308, 408, a roller 416 attached to one end of the step support 308, 408, and a foot assembly 316 attached to the other end of the step support 308, 408. The roller 416 rolls freely within a corresponding one of the sliding track channels.

As seen in FIG. 8, the steps 212 are pivotally supported by the two front step support assemblies 304 located in the front of the steps 212 and the two back step support assemblies 404 located in the back of the steps 212. The steps 212 are secured to the front assemblies 304 and back step assemblies 404 with external retaining rings 216 in the receiving grooves at the ends of the step rods 214. One front step support assembly 304 and one back step support assembly 404 are positioned on the left side of the steps 212, while one front step support assembly 304 and one back step support assembly 404 are positioned on the right side of the steps 212. Thus, the steps 212 are supported on four corners by the two front step assemblies 304 and two back step support assemblies 404. Each front step support assembly 304 comprises a front step support 308 and a foot assembly 316 (see FIGS. 12 and 12*b*). Each back step support assembly 404 comprises a back step support 408 and a foot assembly 316 (see FIGS. 12*a* and 12*b*).

A first step 212 is supported by a middle section of the step support assemblies 304, 404 while a second step 212 is supported by a top section of the step support assemblies 304, 404. In the extended configuration as shown in FIG. 8, the four step support assemblies 304, 404 are dropped down to have the feet 320 placed on the floor. Although the step supports 308, 408 form an angle with the floor 600, the feet 320 are always in the vertical position allowing a firm positioning to the floor 600. The steps 212 are always in a horizontal position allowing various installations to provide different heights.

Figure 9:
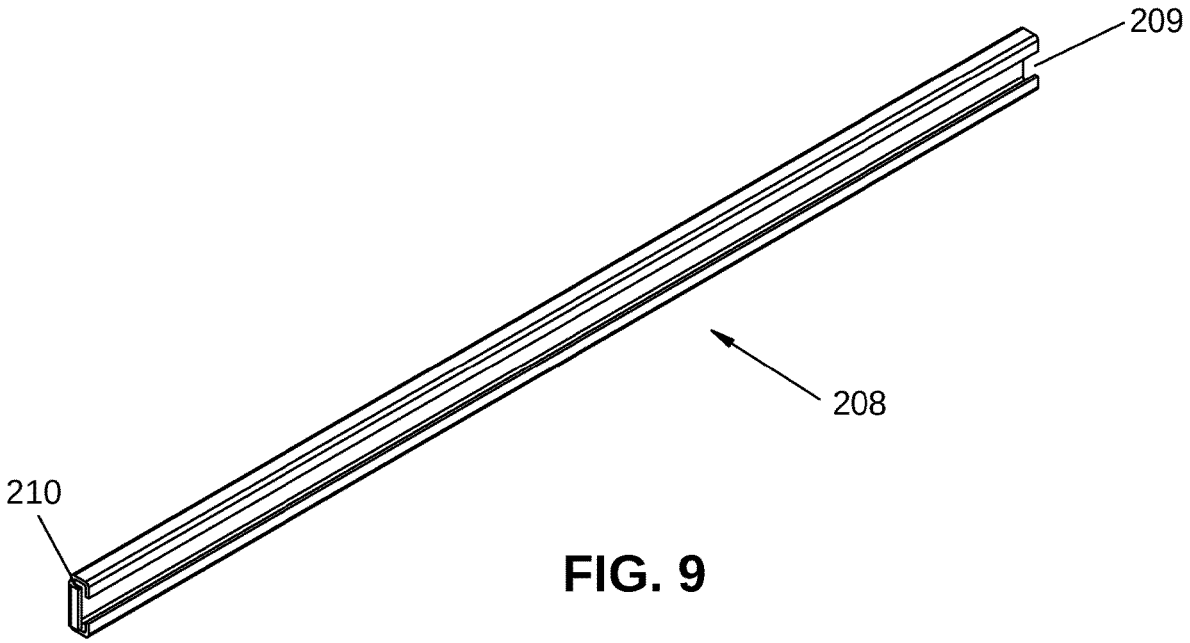
FIG. 9 is an isometric view of the sliding track channel according to the embodiment of the present invention of FIG. 8.

Referring to FIG. 9, there illustrated is an exemplary embodiment of a sliding track channel 208. The sliding track channel 208 is similar to the fixed track channel 112 in the channel structure. However, the sliding track channels 208 have a smaller dimension in order to be nested in the fixed track channel 112. The sliding track channel 208 is constructed of a one-piece material shaped into a channel with a channel opening 209 facing sideway to provide track for the rollers 416. The sliding track channel 208 has a front end plate 210 to block the roller from rolling out of the front end of the sliding track channel 208.

Figure 10:
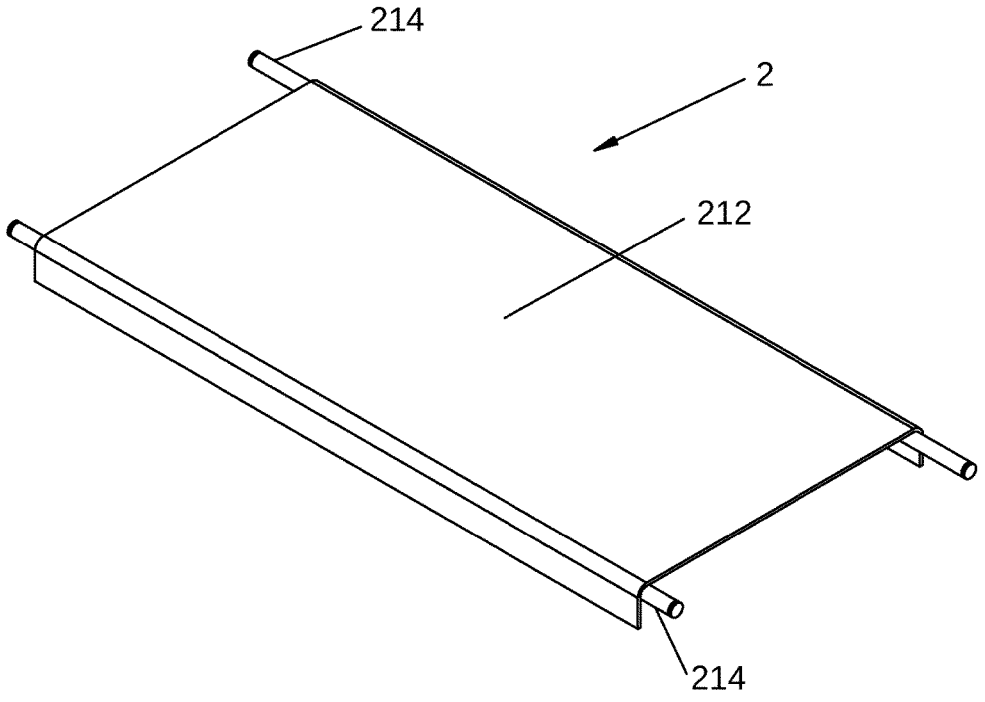
FIG. 10 is an isometric view of a step according to the embodiment of the present invention of FIG. 8.

Referring to FIG. 10, there illustrated is an exemplary embodiment of a step 212. The step 212 is made of a one-piece material folded into an inverted U-shape and two rods 214 attached to the downward facing surface of the step 212 along lengthwise edge corners of the step 212. One rod 214 is placed in the front edge of the step 212 and the other rod 214 is placed in the back edge of the step 212. The rod ends 214 extend out of the step 212 to function as pins for pivotally binding the step 212 with the front step support assemblies 304 and back step support assemblies 404. The ends of rods 214 have receiving grooves at the ends to accept external retaining rings 216 when installed in front step support assemblies 304 and back step support assemblies 404.

Figure 11:
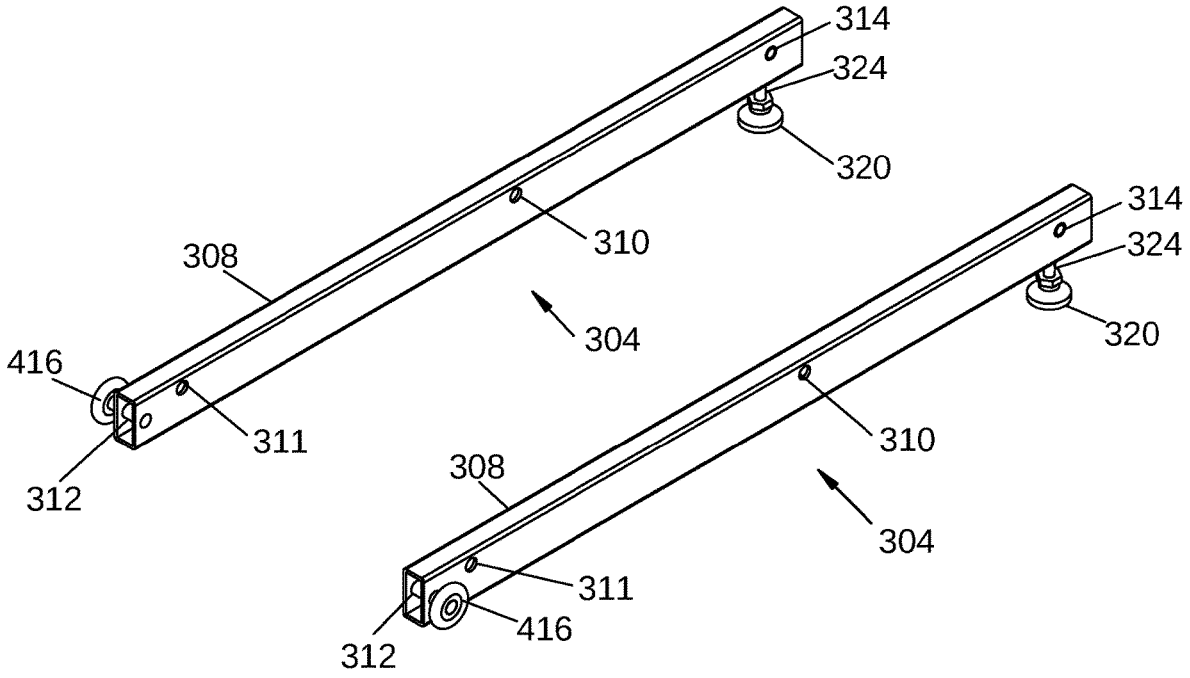
FIGS. 11 is an isometric view of a pair of front step support assemblies according to the embodiment of the present invention of FIG. 1.

Referring to FIG. 11, there illustrated is an isometric view of a pair of the front step support assemblies 304 aligned in parallel with each other. A left front step support assembly 304 is in the left configuration and a right front step support assembly 304 is in the right configuration. A space that separates the two front step support assemblies 304 is for mounting the steps 212 as shown in FIG. 8.

Figure 12A:
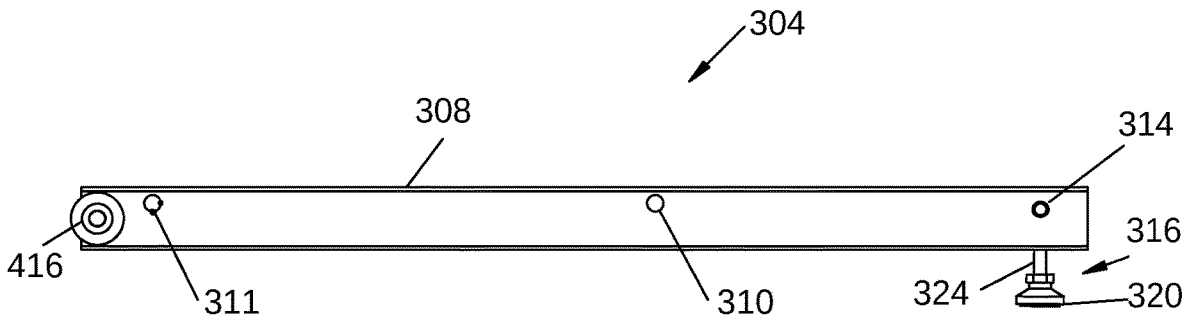
FIGS. 12*a* and 12*b* are a left side view and a back side view, respectively, of a front step support assembly in a left configuration according to the embodiment of the present invention of FIG. 11.
Figure 12B:
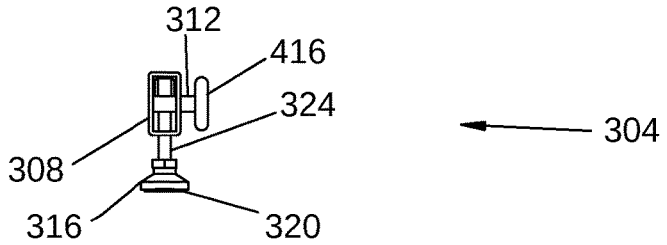

Referring to FIGS. 12*a* and 12*b*, there illustrated are a left side view and a back side view, respectively, of the front support assembly 304 in the left configuration. Each front step support assembly 304 comprises a step support 308, a roller 416 attached to the front step support 308 facing outward, and a foot assembly 316 pivotally attached to the front step support 308. There are four holes 309, 310, 311, 313 in the step support 308. The foot assembly 316 is pivotally attached to the front step support 308 using a relatively short axle pin, hereinafter designated as axle pin short 314, through a first hole 309 located near the front end of the front step support 308. The roller 416 is pivotally attached to the front step support 308 through a fourth hole 313 located near the back end of the front step support 308 using an intermediate length axle pin, hereinafter designated as axle pin medium 312. As shown in FIG. 12*a*, the foot assembly 316 is rotatable around the axle pin short 314 as axis in a range between a vertical position to a horizontal position.

As shown in FIG. 12*b*, from the back side view of the front step support assembly 304 in the left configuration, the foot assembly 316 is fitted into a tubing interior of the front step support assembly 304 while the roller 416 is on the left side of the step support assembly 304. The axle pin medium 312 pins through the roller 416 and the fourth hole 313 in the front step support 308. The fourth hole 313 in the step support 308 is located in a middle level centered between upper and lower walls of the front step support 308.

Similarly, for the front step support assembly 304 in the right configuration, the foot assembly 316 is fitted into the tubing interior of the front step support 308 while the roller 416 is on the right side of the front step support assembly 304. The axle pin medium 312 pins the roller 416 through the roller 416 and the fourth hole 313 centered in the middle level of the front step support 308.

Figure 13:
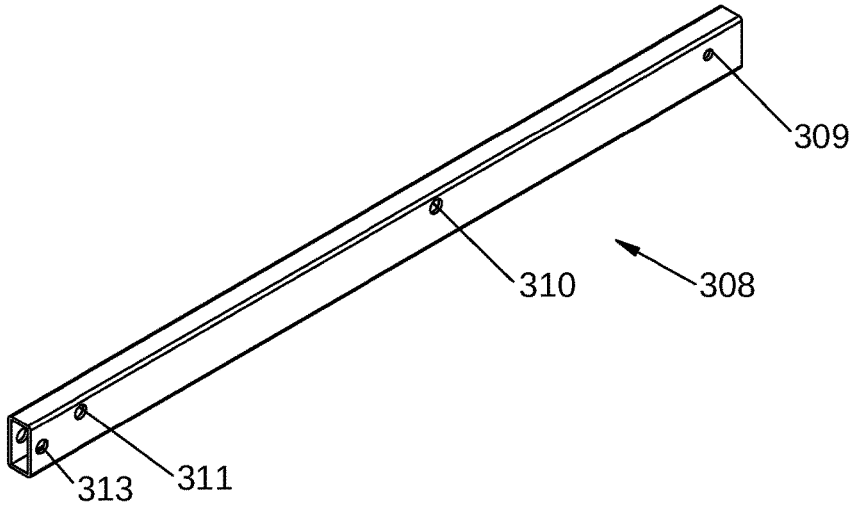
FIG. 13 is an isometric view of a front step support according to the embodiment of the present invention of FIG. 11.

Referring to FIG. 13, there illustrated is an isometric view of a front step support 308. The front step support 308 is constructed of a tube with a rectangular cross-section. The tube includes an upper wall, a lower wall, and two vertical side walls. An end section of the material is removed from the lower wall of the front step support 308 to allow the foot assembly 316 to rotate such that it can always remain in the vertical orientation with respect to the floor 600 (see FIGS. 11, 12*a*, and 12*b*). Going through the two side walls of the front step support 308 are four through holes 309-311 and 313. The first three holes 309-311 are positioned above a middle level centered between the upper wall and lower wall of the step support 308, while the fourth hole 313 is centralized at the middle level. The third hole 311 and the fourth hole 313 are located near the back end of the step support 308. The first hole 309, located close to the front end of the tubing, is for pinning the foot assembly 316 to the step support 308 using an axle pin short 314. The second hole 310 and the third hole 311 are for pinning a first step 212 and a second step 212, respectively, to the front step support 308 using front rod ends 214 as pins. The fourth hole 313 is for pinning the roller 416 to the front step support 308 using an axle pin medium 312.

Figure 14:
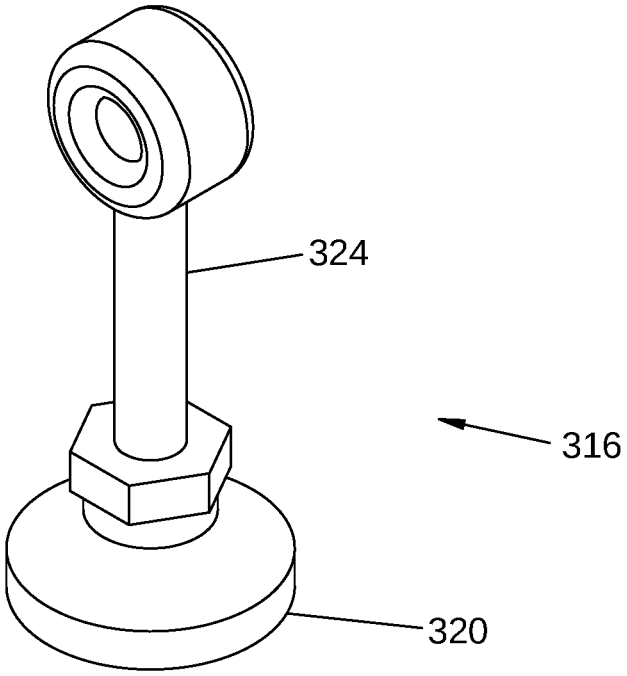
FIG. 14 is an isometric view of a foot assembly according to the embodiment of the present invention of FIG. 1.
Figure 15:
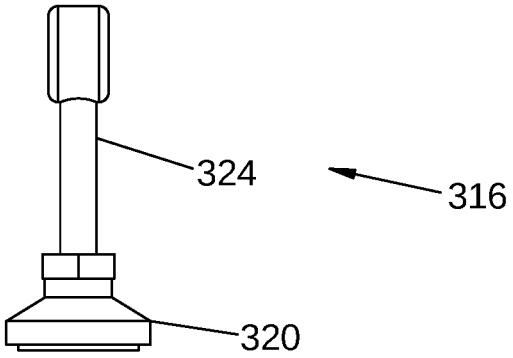
FIG. 15 is a side view of the foot assembly according to the embodiment of the present invention of FIG. 14.

Referring to FIGS. 14 and 15 according to an embodiment of the present invention of FIG. 1, a foot assembly 316 comprises a rod end bolt 324 attached to the foot 320. The rod end bolt 324 is a pivotal connector, comprising a pin rod on one end and an O-ring as a pin hole on the other end. The foot assembly 316 is pinned to the front step support 308 through the O-ring of the rod end bolt 324 and the first hole 309 in the front step support 308 using an axle pin short 314. As seen in FIG. 15, a side view of the foot assembly 316 shows that the O-ring of the rod end bolt 324 can fitted into the tubing interior of the step support 308. In addition to the foot assembly 316 in this exemplary embodiment, various other foot mechanisms may take the place of the foot assembly 316. One of the main criteria for choosing a suitable foot assembly is to set the step support assembly firmly on the floor without marring the floor surface.

Figure 16:
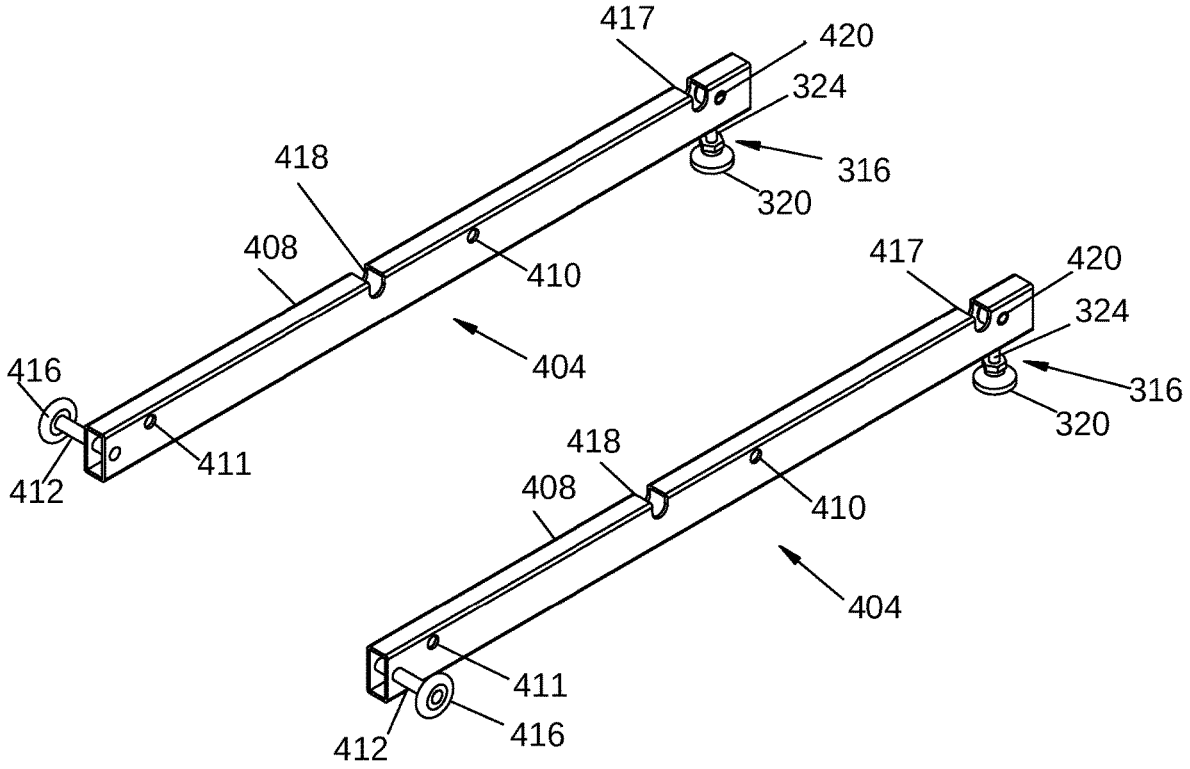
FIG. 16 is an isometric view of a pair of back step support assemblies according to the embodiment of the present invention of FIG. 1.

Referring to FIG. 16, there illustrated is an isometric view of a pair of the back step support assemblies 404 aligned in parallel with each other. A left back step support assembly 404 is in the left configuration and a right back step support assembly 404 is in the right configuration. A space that separates the two back step support assemblies 404 is for mounting the steps 212 as shown in FIG. 8.

Figure 17A:
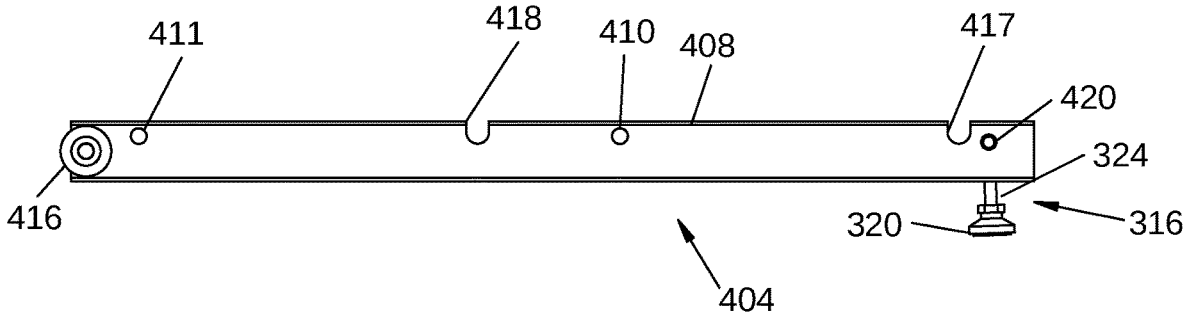
FIGS. 17*a* and 17*b* are a left side view and a back side view, respectively, of the back step support assembly in a left configuration according to FIG. 16.
Figure 17B:
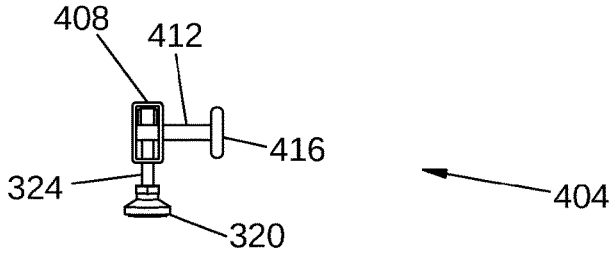

Referring to FIGS. 17*a* and 17*b*, there illustrated are a left side view and a back side view of the back support assembly 404 in the left configuration, respectively. Each back step support assembly 404 comprises a step support 408, a roller 416 attached to one end of the back step support 408 facing outward, and a foot assembly 316 pivotally attached to the other end of the back step support 408. The back step support 408 is constructed of a tube with a rectangular cross-section. The tube includes an upper wall, a lower wall, and two vertical side walls. An end section of the material is removed from the lower wall of the back step support 408 to allow the foot assembly 316 to rotate such that it can always remain in the vertical orientation with respect to the floor 600 (see FIGS. 16, 17*a*, and 17*b*). The back step support assemblies 404 are structurally similar to the front step support assemblies 304 with one exception that each back step support assembly 404 has two grooved recesses 417, 418 located in the upper wall of the back step support 408.

As shown in FIG. 17*a*, there are four through holes 409-411 and 413 going through the two side walls of the back step support 408. The first three holes 409-411 are positioned above a middle level centered between the upper wall and lower wall of the back step support 408 and the fourth hole 413 is centralized at the middle level. The third hole 411 and fourth hole 413 are located near the back end of the step support 308. The first hole 409, located close to the front end of the back step support assembly 404, is for pinning the foot assembly 316 to the back step support 408 using a relatively short axle pin, hereinafter designated as axle pin short 420. The roller 416 is pivotally attached to the back step support 408 through a fourth hole 413 located near the back end of the back step support 408 using a long axle pin, hereinafter designated axle pin long 412. As shown in FIG. 17*a*, the foot assembly is rotatable around the axle pin short 420 as axis in a range between a vertical position to a horizontal position.

As shown in FIG. 17*b*, from the back side view of the back step support assembly 404 in the left configuration, the foot assembly 316 is fitted into the tubing interior of the back step support assembly 404 while the roller 416 is located on the left side of the back step support assembly 404. The roller 416 is pivotally attached to the back step support 408 by pinning through the roller 416 and the fourth hole 413 in the back step support 408 using an axle pin short 420.

Similarly, for the back step support assembly 404 in the right configuration, the foot assembly 316 is fitted into the tubing interior of the support assembly 404 and the roller 416 is on the right side of the back step support assembly 404. The axle pin short 420 pins through the roller 416 and the fourth hole 413 in the back step support 408.

Figure 18:
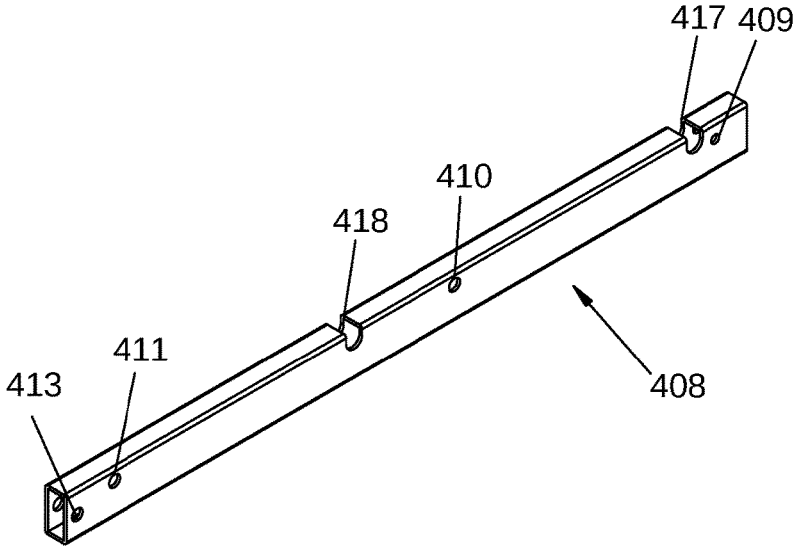
FIG. 18 is an isometric view of the back step support according to FIG. 17*a*.

Referring to FIG. 18, there illustrated is an isometric view of a back step support member 408. The back step support 408 is constructed of a tube with a rectangular cross-section. The tube includes an upper wall, a lower wall, and two vertical side walls. There are four through holes going through the two side walls of the back step support 408. The first three holes 409-411 are positioned above a middle level centered between the upper wall and the lower wall of the back step support 408, and the fourth hole 413 is centralized at the middle level. The third hole 411 and the fourth hole 413 are located near the back end of the back step support 408. The first hole 409, located close to the front end of the tubing, is for pinning the foot assembly 316 to the step support 408 using an axle pin short 420. The second hole 410 and the third hole 411 are for pinning the first step 212 and second step 212, respectively, to the back step support 408 using rod ends of the back rod 214 as pins. The fourth hole 413 is for pinning the roller 416 to the back step support 408 using an axle pin long 412.

The two grooved recesses 417, 418 located in the upper wall of the back step support 408 are for a section of the two rods 214, one of which is located in the front of the first step 212 and the other one is located in the front to the second step 212. The rods 214 fit into the recesses 417, 418 when in the closed configuration that allows the back step support assemblies 404 to fully rise into the retracted position.

Figure 19A:
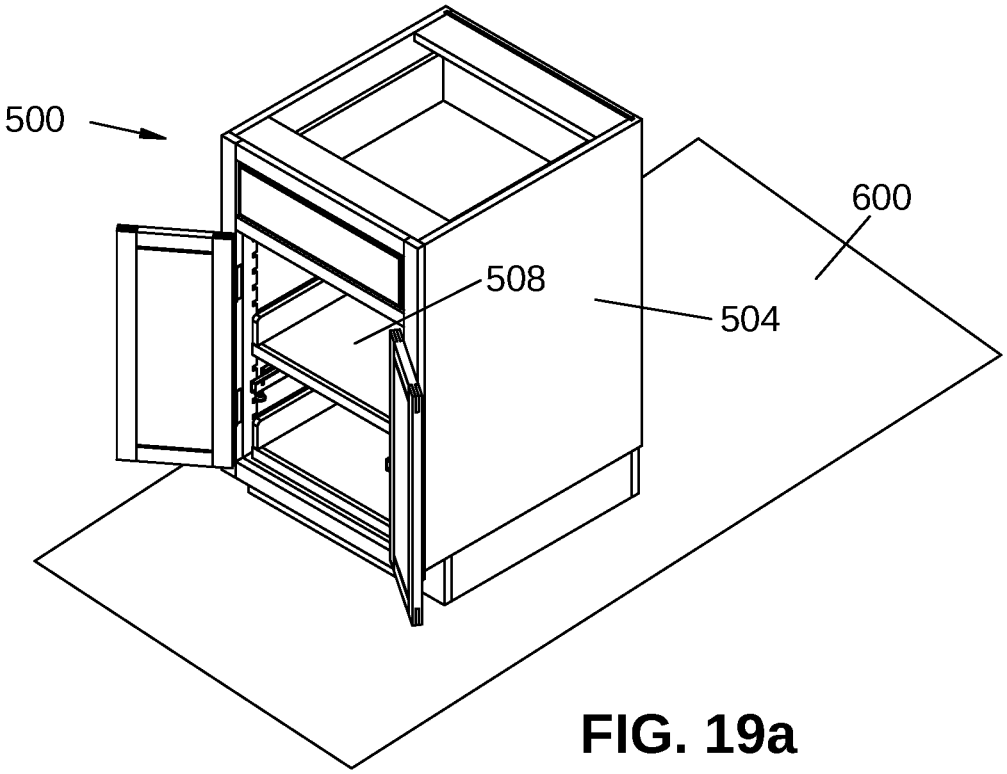
FIGS. 19*a* and 19*b* are isometric views of a cabinet mounted step stool in a closed configuration and an extended configuration, respectively, according to the embodiment of the present invention.
Figure 19B:
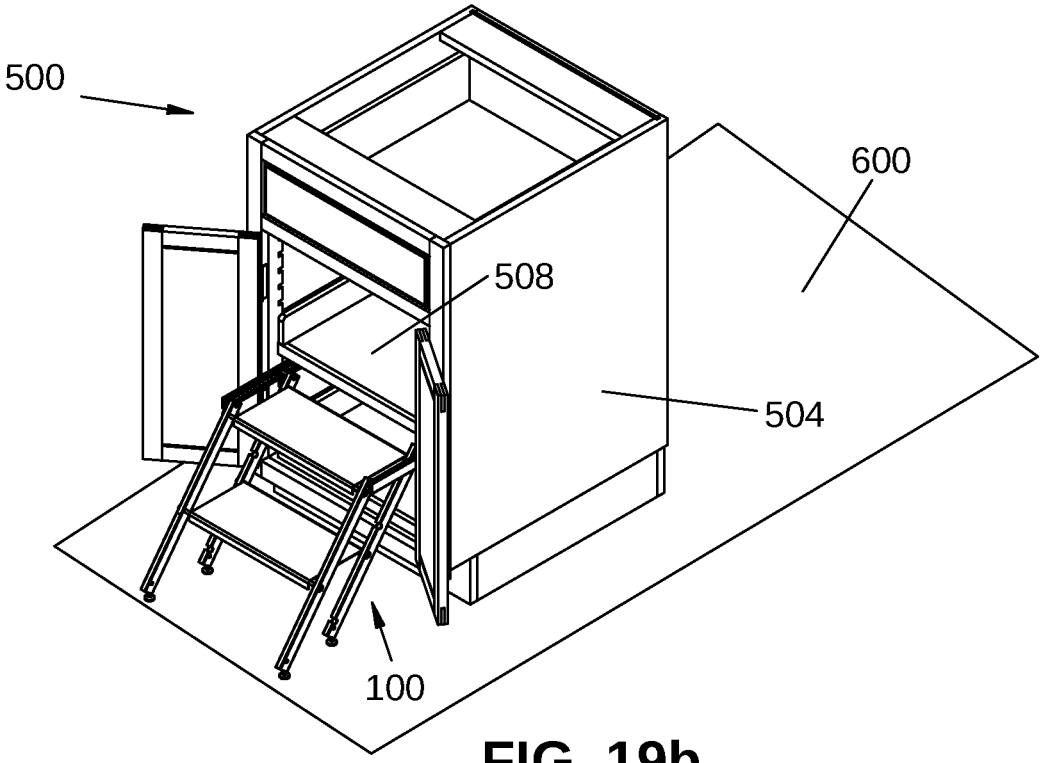

Referring to FIGS. 19*a* and 19*b*, according to an embodiment of the present invention, there illustrated are isometric views of a step stool mounted within a cabinet 500. The cabinet 500 comprises side walls 504 and a shelf 508. The step stool 100 is located under the shelf 508 and installed on the two interior side walls 504 within the cabinet 500.

As shown in FIG. 19*a*, the step stool 100 is in a closed configuration, where the step stool 100 stored under the shelf does not affect the useful storage space of the cabinet 500. As shown in FIG. 19*b*, the step stool 500 is in an extended configuration, where the step stool 100 is pulled out of the cabinet 500 and the four step support assemblies 304, 404 are pushed down to have the feet 320 firmly placed on the floor 600 in the vertical position. In the step stool 100 shown in FIGS. 19*a* and 19*b*, the cabinet 500 has an upper recess where a basin or a wash tub may be located. Although the cabinet 500 may be a kitchen cabinet or a bathroom cabinet, other kinds of cabinets, such as cabinets with insets or overlay doors, or cabinets with or without cabinet face frame may be utilized as a support structure for the step stool 100.

The terminology used herein is for the purpose of describing particular embodiments of the invention only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the invention is provided in detail in connection with only a limited number of embodiments, it should be readily understood that the invention is not limited to such disclosed embodiments. Rather, the invention can be modified to incorporate any number of variations, alterations, substitutions, or equivalent arrangements not heretofore described, but which are commensurate with the spirit and scope of the invention. Additionally, while various embodiments of the invention have been described, it is to be understood that the exemplary embodiments may include only some of the described exemplary aspects. Accordingly, the invention it not to be seen as limited by the foregoing description but is only limited by the scope of the appended claims.

The invention claimed is:

1. A step stool comprising:

1) a support channel assembly including:

a plurality of support channels oriented parallel with each other, wherein each of the support channels is attached to a side wall of a support structure, the support structures being selected from a group including a cabinet, a kitchen appliance, or a bathroom vanity; and a left fixed track channel and a right fixed track channel, each one of the fixed track channels having an opening, wherein the left fixed track channel and the right fixed track channel are positioned and fixed to the support channels such that the openings of the fixed track channels face each other; and 2) a step assembly including:

a left sliding track channel and a right sliding track channel, each one of the sliding track channels having an opening, wherein the left sliding track channel slides within the left fixed track channel and the right sliding track channel slides within the right fixed track channel, the openings of the two sliding track channels facing each other;

a foot assembly including a foot;

a pair of front step support assemblies including a left front step support assembly and a right front step support assembly, wherein each one of the front step support assemblies comprises a front step support, one end of the front step support being pivotally attached to a front roller and another end of the front step support being pivotally attached to the foot assembly, wherein the left front roller rolls within the left sliding track channel and the right front roller rolls within the right sliding track channel;

a pair of back step support assemblies including a left back step support assembly and a right back step support assembly, wherein each one of the back step support assemblies comprises a back step support, one end of the back step support being pivotally attached to a back roller and another end of the back step support being pivotally attached to the foot assembly, wherein the left back roller rolls within the left sliding track channel and the right back roller rolls within the right sliding track channel; and a plurality of steps, each one of the steps including a first surface for ascending and standing on the step stool and a second surface bound by a front rod and a back rod, wherein the front rod and the back rod are located at a front edge and a back edge, respectively, of the step, the front rod and the back rod being aligned lengthwise along the step;

wherein each end of the front rod is pivotally fastened to one of the front step support assemblies located in a corresponding side of the front step support assembly at a first height, wherein each end of the back rod is pivotally fastened to one of the back step support assemblies located in a corresponding side of the back end support assembly at the first height.

2. The step stool of claim 1, wherein the support channel is attached to the side wall of the support structure by a mounting clip.

3. The step stool of claim 1, wherein the fixed track channels are oriented transverse to the support channels.

4. The step stool of claim 1, wherein the first surface of the step is an upward facing surface and the second surface of the step is a downward facing surface.

5. The step stool of claim 1, wherein the foot of the foot assembly comprises a foot arrangement that rests the step support assembly on the floor without marring a surface of the floor.

6. The step stool of claim 1, wherein the foot assembly further includes a rod end bolt attached to the foot, the rod end bolt pivotally attaching the foot to the step support.

7. The step stool of claim 1, wherein the left front step support assembly and the left back step support assembly are both positioned on the left side of the steps, and wherein the right front step support assembly and the right back step support assembly are both positioned on the right side of the steps.

8. The step stool of claim 1, wherein the cabinet has at least one shelf, the step stool being installed under the at least one shelf.

9. The step stool of claim 2, wherein the mounting clip is attached to the support channel by a bolted joint using a bolt and a lockout nut.

10. The step stool of claim 2, wherein the position of the mounting clip on the support channel is adjustable before being attached to the support channel for extending to the side wall of the support structure.

11. The step stool of claim 4, wherein the step is inverted U-shaped, and wherein the front rod and the back rod are bound to the downward facing surface at a front edge corner and at a back edge corner, respectively, of the step.

12. The step stool of claim 1, wherein the plurality of steps comprises two steps.

13. The step stool of claim 1, wherein a step height is defined as the height between the two adjacent steps and is in a range between 5.5" and 6.5".

14. The step stool of claim 1, wherein the step stool is in a closed configuration to be stored within the support structure, the closed configuration being characterized by the following features:

the sliding track channels being retracted and nested in the fixed track channels;

the front and back step support assemblies being juxtaposed against the sliding track channels in the corresponding side; and the steps being placed in juxtaposition between the sliding track channels in a planar orientation and supported by the support channels.

15. The step stool of claim 1, wherein the step stool is in an extended configuration, the extended configuration being characterized by the following features:

the sliding track channels partially sliding out of the fixed track channels and out of the support structure;

the front and back step support assemblies having the feet placed on the floor in a vertical position; and the steps being placed horizontally in an ascending order.

16. The step stool of claim 1, wherein each one of the back step supports comprises two grooved recesses located in an upper wall of the back step support for the front rods to fit into the grooved recesses when in the closed configuration.

17. The step stool of claim 1, wherein the front rod of the step and the back rod of the step are pivotally fastened to the front step support and the back step support, respectively, by each rod end disposed through a hole in one of the front step support and the back step support located in a corresponding side of the one of the front step support and the back step support, the rod end being retained by a retaining ring.

* * * * *